US012221303B2

(12) United States Patent
Dahlqvist et al.

(10) Patent No.: US 12,221,303 B2
(45) Date of Patent: Feb. 11, 2025

(54) SHEET FEEDER WITH SHEET FORMING MEANS

(71) Applicant: Plockmatic International AB, Hägersten (SE)

(72) Inventors: Patrik Dahlqvist, Täby (SE); Fredrik Irlén, Älta (SE)

(73) Assignee: Plockmatic International AB, Hägersten (SE)

( * ) Notice: Subject to any disclaimer, the term of this patent is extended or adjusted under 35 U.S.C. 154(b) by 0 days.

(21) Appl. No.: 17/593,433

(22) PCT Filed: Mar. 20, 2020

(86) PCT No.: PCT/EP2020/057736
§ 371 (c)(1),
(2) Date: Sep. 17, 2021

(87) PCT Pub. No.: WO2020/188072
PCT Pub. Date: Sep. 24, 2020

(65) Prior Publication Data

US 2022/0169459 A1 Jun. 2, 2022

(30) Foreign Application Priority Data

Mar. 20, 2019 (SE) ..... 1950350-7

(51) Int. Cl.
*B65H 1/04* (2006.01)
*B65H 1/14* (2006.01)
(Continued)

(52) U.S. Cl.
CPC ..... *B65H 1/04* (2013.01); *B65H 1/14* (2013.01); *B65H 3/128* (2013.01); *B65H 3/48* (2013.01);
(Continued)

(58) Field of Classification Search
CPC ..... B65H 1/04; B65H 3/047; B65H 3/128; B65H 3/48; B65H 3/66; B65H 2301/4234;
(Continued)

(56) References Cited

U.S. PATENT DOCUMENTS 8,833,755 B2 9/2014 Toyooka et al.
9,701,495 B2 * 7/2017 Ito ..... B65H 7/02
(Continued)

FOREIGN PATENT DOCUMENTS

EP 1820760 A1 8/2007
EP 3015408 A1 5/2016
(Continued)

OTHER PUBLICATIONS

International Search Report and Written Opinion for PCT Application No. PCT/EP2020/057736, dated Jul. 6, 2020, 8 pages.
(Continued)

*Primary Examiner* — Prasad V Gokhale
(74) *Attorney, Agent, or Firm* — Brake Hughes Bellermann LLP

(57) ABSTRACT

Sheet feeding device (1) comprising an elevator (2) for a stack of sheets, and an air supply system (3) configured to supply and direct one of more air streams towards an upper region (4) of the sheet feeding device (1) for floating a plurality of upper sheets of the stack of sheets, wherein the elevator (2) comprises a vertically movable support (5) for supporting the stack of sheets from below, wherein the sheet feeding device (1) comprises a first side support member (6) and a second side support member (7) configured to sideways support respective opposite sides of the stack of sheets, wherein the sheet feeding device (1) further comprises a vacuum belt feeder (8) provided above the elevator (2) and configured to grab and feed an uppermost sheet of the floated sheets away from the floated sheets, and wherein an upper portion of each side support member (6, 7) is provided with at least one respective cam (9) comprising a respective guide surface extending obliquely upwards-inwards from the respective side support member (6, 7).

8 Claims, 4 Drawing Sheets

(51) Int. Cl.
*B65H 3/12* (2006.01)
*B65H 3/48* (2006.01)
*B65H 3/66* (2006.01)

(52) U.S. Cl.
CPC ..... *B65H 3/66* (2013.01); *B65H 2301/4234* (2013.01); *B65H 2403/51* (2013.01); *B65H 2404/741* (2013.01); *B65H 2405/1142* (2013.01); *B65H 2405/11425* (2013.01); *B65H 2405/15* (2013.01); *B65H 2511/12* (2013.01)

(58) Field of Classification Search
CPC ..... B65H 2403/51; B65H 2404/26; B65H 2404/511; B65H 2404/512; B65H 2404/741; B65H 2405/114; B65H 2405/1142; B65H 2405/11425; B65H 2405/1144; B65H 2405/15
See application file for complete search history.

(56) References Cited

U.S. PATENT DOCUMENTS

| | | | | |
|---|---|---|---|---|
| 9,796,552 | B2 | 10/2017 | Fukumoto et al. | |
| 2006/0191430 | A1* | 8/2006 | Nakashima | B41J 13/103 101/232 |
| 2010/0148430 | A1* | 6/2010 | Fuda | B65H 1/04 271/145 |
| 2012/0025446 | A1 | 2/2012 | Ikeda | |
| 2012/0061910 | A1 | 3/2012 | Ford et al. | |
| 2016/0334747 | A1 | 11/2016 | Wakabayashi et al. | |
| 2019/0127163 | A1* | 5/2019 | Sakamoto | B65H 3/48 |
| 2020/0071102 | A1* | 3/2020 | Masuda | B65H 5/228 |

FOREIGN PATENT DOCUMENTS

| | | | |
|---|---|---|---|
| EP | 3476783 | A1 | 5/2019 |
| JP | S57-117435 | A | 7/1982 |
| JP | S58-128728 | U | 8/1983 |
| JP | S63-126347 | U | 8/1988 |
| JP | H2-43841 | U | 3/1990 |
| JP | H3-293236 | A | 12/1991 |
| JP | H7-97082 | A | 4/1995 |
| JP | H9-309624 | | 12/1997 |
| JP | H09309624 | A | 12/1997 |
| JP | 2002302269 | A * | 10/2002 |
| JP | 2015091733 | A | 5/2015 |
| JP | 2017193439 | A | 10/2017 |
| JP | 2018024508 | A | 2/2018 |

OTHER PUBLICATIONS

Office Action issued in JP 2021-556517 mailed on Mar. 19, 2024 along with machine English translation, 12 pages.
Office Action for Sweden Patent Application No. 1950350-7, mailed on Oct. 4, 2019, 8 pages.

* cited by examiner

SHEET FEEDER WITH SHEET FORMING MEANS

CROSS REFERENCE TO RELATED APPLICATIONS

This application is a 35 U.S.C. § 371 National Phase Entry Application from PCT Application No. PCT/EP2020/057736, filed on Mar. 20, 2020, entitled "SHEET FEEDER WITH SHEET FORMING MEANS", and designating the U.S., which claims priority to Swedish Application No. 1950350-7, filed on Mar. 20, 2019, the disclosures of which are incorporated herein in their entireties by reference.

TECHNICAL FIELD

The present disclosure relates to sheet feeding devices for the printing industry, for example sheet feeding devices for printers, copiers or sorters.

BACKGROUND

Sheet feeding devices are commonly integrated into printers or copiers and are manually loaded with a large number of sheets in order to automatically provide sheets, one by one, for a subsequent operation on the sheet, such as printing or sorting.

One example of a prior art sheet feeding device by the present applicant is described in the international patent application published under number WO 2015/147732 A1. The sheet feeding device comprises a storage surface for a stack of papers. The storing surface is adapted to be moved vertically between a first, lower end position and a second, upper end position as sheets are consumed from the top of the stack of sheet. The sheet feeding device further comprises a feeding roll for feeding papers from their position above the storage surface and imparting an uppermost sheet of paper a horizontal displacement. Also, the feeding roll is movably attached such that it can pivot in order to account for variations in the angle of the uppermost sheet of the stack of papers. The feeding roll is driven by a motor.

A challenge for sheet feeding devices is to manage sheets of various materials and qualities whilst minimizing or eliminating problems associated with double-feed, sheet jam or manual configuration and adjustment for operating the sheet feeding device with different sheet sized and qualities.

SUMMARY

Accordingly, the present disclosure aims to mitigate the above mentioned drawbacks singly or in combination by providing a sheet feeding device as defined in the appended independent claims. The sheet feeding device comprises an elevator for a stack of sheets, and an air supply system configured to supply and direct one of more air streams towards an upper region of the sheet feeding device for floating a plurality of upper sheets of the stack of sheets, wherein the elevator comprises a vertically movable support for supporting the stack of sheets from below. The sheet feeding device also comprises a first and a second side support member configured to sideways support respective opposite sides of the stack of sheets. Also, the sheet feeding device comprises a vacuum belt feeder provided above the elevator and configured to grab and feed away an uppermost sheet of the floated sheets. Further, an upper portion of each side support member is provided with at least one respective cam comprising a respective guide surface extending obliquely upwards-inwards from the respective side support member. Each 'cam' could alternatively be referred to as a 'guide means'.

The sheet feeding device is normally used before a printer or copier to supply individual sheets one by one to the printer/copier. To enable this, a stack of sheets is loaded onto the elevator with the side support members positioned to define a space corresponding to the width of the stack of sheets such that the side support members sideways support the respective opposite sides of the stack of sheets. The elevator then moves the uppermost sheet of the stack of sheets upwards or downwards until it is at a suitable height in the upper region. The air supply system is used to supply and direct an air stream towards the upper region and thereby float a plurality of upper sheets of the stack of sheets such that they are separated and suspended in the air stream. When being floated by the air stream, the uppermost sheets are fed upwards from the stack of sheets and on their way upwards they hit the cams which together define a narrower space than the width between the side support members. Upon hitting the cams, the edges of the sheets are exerted to reactive forces which causes the sheets to take a bent shape. Hence, each sheet follows the cam and thereby acts as a cam follower. The bent shape is advantageous since is makes the sheet stiff in one direction, which causes all floated sheets to have a similar shape with less fluctuating regions due to air flow and turbulence. Further, the stiffer sheets can be more predictably handled by the vacuum belt feeder, thereby avoiding sheet jam. The vacuum belt feeder provides a vacuum through its perforated belt which forces the uppermost of the floated sheets against the belt such that the belt can be operated to thereby move the sheet and feed it away for subsequent processing.

Each cam may be resilient. The resiliency of the cam enables the surface of the cam to deform and/or move upon exertion of reactive forces from the sheet(s) contacting the cam. Thereby, the friction between cam and sheet is limited such that the sheet feeding device can be used with sheets of varying stiffness with reduced risk of badly functioning sheet separation or stuck sheets.

Each cam may comprise an elongate resilient stem by which the cam is attached to the respective side support member. The elongate resilient stem enables use of a rigid cam portion whilst enabling sustained or improved resiliency of the cam as a whole. The stem bends upon application of force from the sheet edge(s) on the cam, thereby limiting the reactive force. The longer the stem, the lower the amount of rotation of the cam will be upon movement of the cam. The force spring constant offered by the resilient stem is substantially even throughout its range of movement in use since the stem needs only to deform a little to enable the required freedom of movement of the cam.

Each stem may extend vertically below the respective cam on the outside of the respective side support member facing away from the stack of sheets, wherein a lower portion of the stem is attached to the side support member. Be letting the stem extend below the cam, the upper portion of the cam will open outwards upon outward movement which means that the angle of attack between cam and sheet will not increase upon pressing the cam outwards but will decrease. Further, by letting the stem extend on the outside of the support member, the stem will not touch the sheet, thereby reducing the risk of sheet jam.

The side support members may be provided with an opening or recesses, wherein each respective cam extends through each respective opening or recess from the outside of the respective side support member to its inside. Be letting the cam extend through the opening or recess the overlap between the inner surface of the side support and the cam is smooth with no bump. This reduces the risk of sheet jam and of damaging the edges of the sheet.

The cam may be provided with a stepped guiding surface. The provision of steps provides a plurality of cam portions with increased resistance for the sheets to slide along at floating and thereby promotes controlled separation of floated sheets The first and second side support members may be movably attached to the sheet feeding device such that their mutual intermediate distance is adjustable for supporting stacks of different width. This enables use of the sheet feeding device with different types of sheets.

The vertically movable support comprises a raised central portion extending along the length of the sheet feeding device in the feeding direction of the sheet feeding device. The raised central portion provides a raised support at a central portion of the stack of sheets such that all stacked sheets are bent. This enables easier floating and separation of sheets.

The vacuum belt feeder comprises opposite outer lower belt portions separated by an intermediate lower belt portion provided higher than the outer portions. The higher position of the intermediate lower belt portion provides the uppermost floated sheet with extra room such that the central portion of the uppermost floated sheet, which is bent by the cams, is allowed to move further upwards wherein the outer portions of the uppermost floated sheet are brought closer to the outer belt portions. Thereby, all belt portions will be able to jointly act to attract the uppermost sheet.

| | |
|---|---|
| 1 | aheet feeding device |
| 2 | elevator |
| 3 | air supply system |
| 4 | upper region |
| 5 | vertically movable support |
| 6 | first side support member |
| 7 | second side support member |
| 8 | vacuum belt feeder |
| 9 | cam |
| D1 | upwards-inwards direction, left |
| 10 | stem |
| 11 | opening/recess |
| 12 | guiding surface |
| 13 | raised central portion |
| 14 | feeding direction of sheet |

-continued

| | |
|---|---|
| 15 | outer lower belt portion |
| 16 | intermediate lower belt portion |
| 17 | head of cam |
| 18 | stop means |
| D2 | upwards-inwards direction, right |

DETAILED DESCRIPTION

Figure 1:
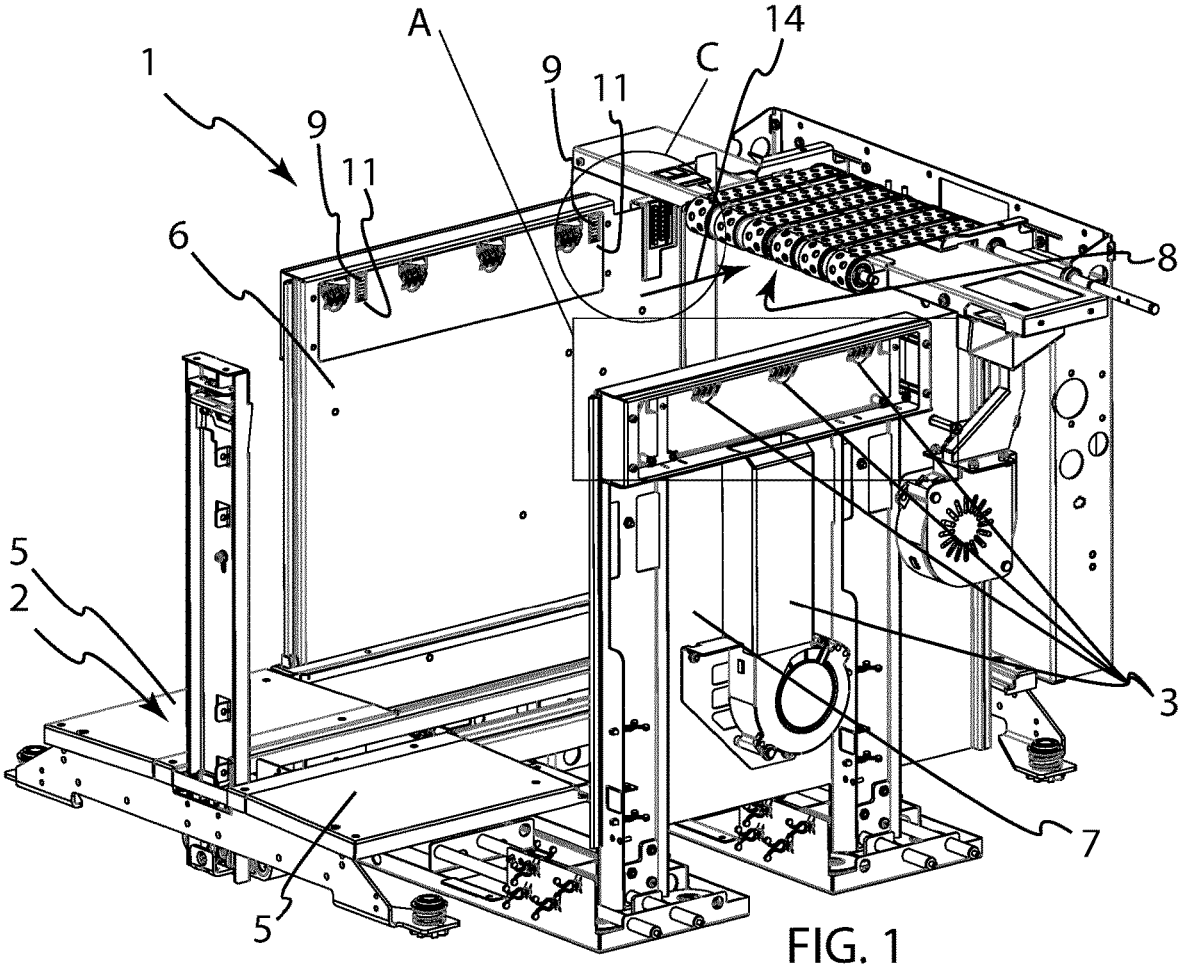
FIG. 1 shows a perspective view of a sheet feeding device according to a first embodiment.
Figure 6:
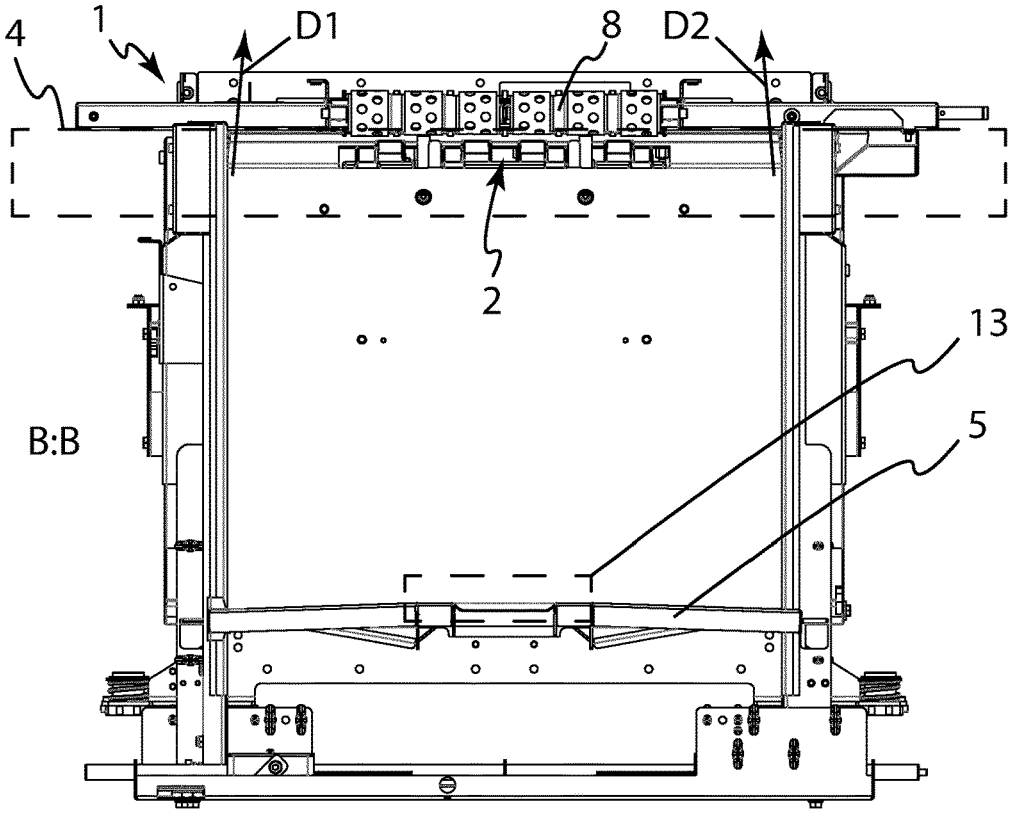
FIG. 6 shows a front view in cross-section B-B as indicated in FIG. 5 of the sheet feeding device also shown in FIGS. 1, 2 and 5.
Figure 7:
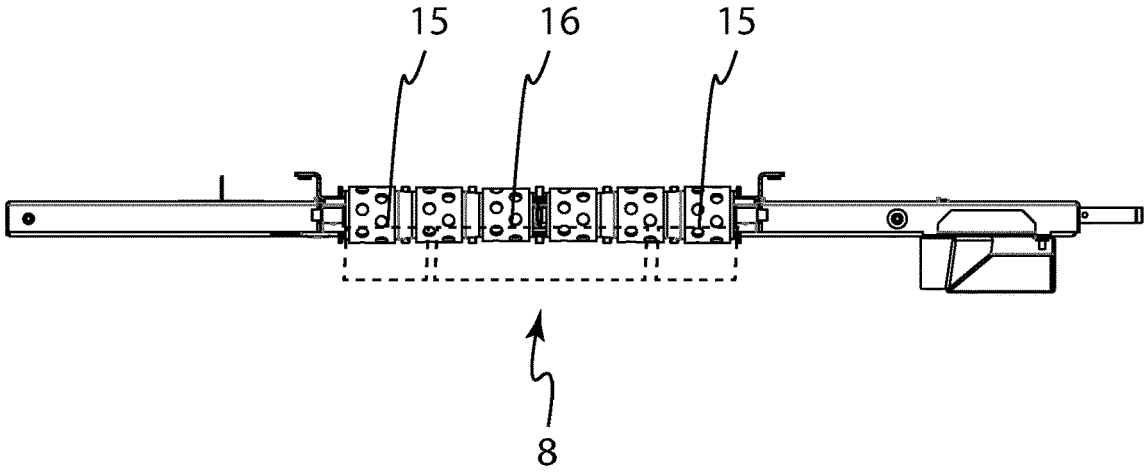
FIG. 7 shows an isolated view of the vacuum belt feeder of the sheet feeding device also shown in FIGS. 1, 2, 5 and 6.
Figure 8:
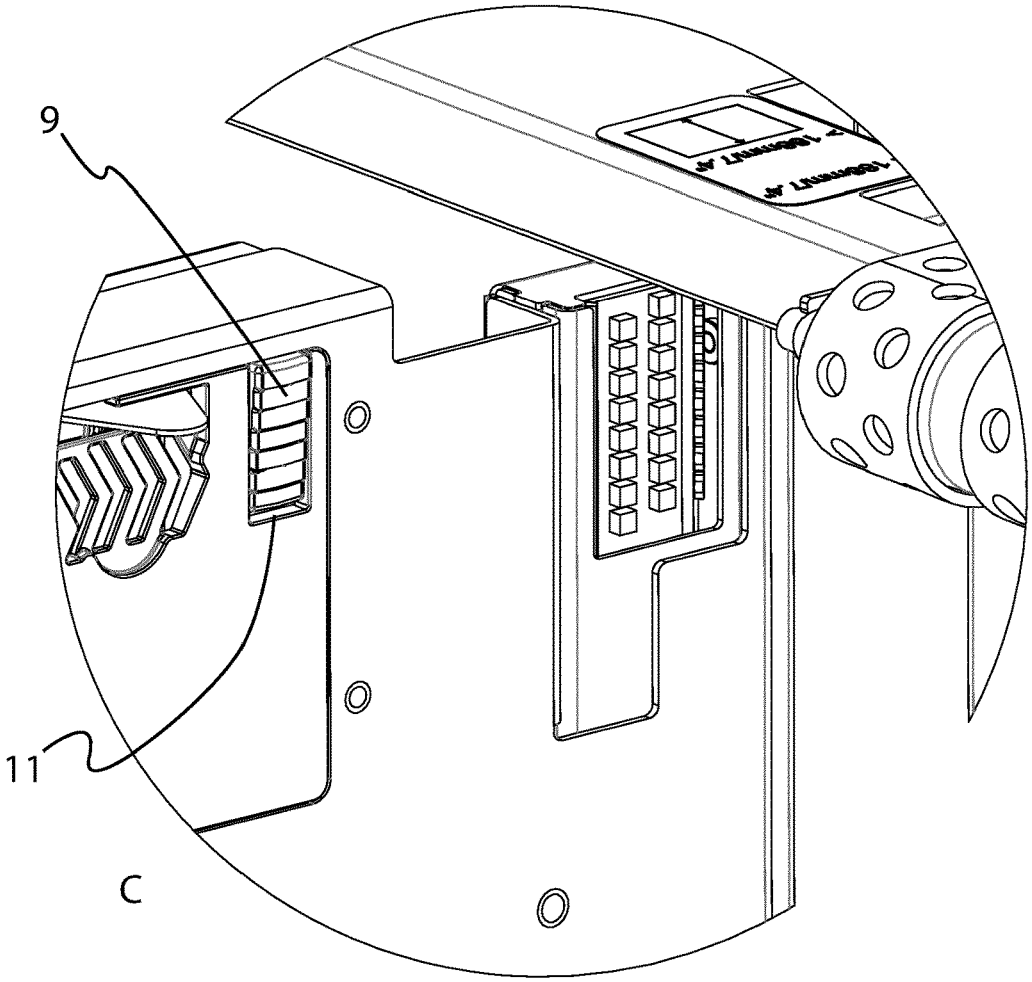
FIG. 8 shows detail view C as indicated in FIG. 1. Specifically, a nozzle of the air supply sytem is visible along with a cam and an optical sensor for measurements of the state of floated sheet.

A first embodiment of the inventive sheet feeding device 1 will hereinafter be described with reference to the appended drawings. As shown in FIGS. 1 and 6, the sheet feeding device 1 comprises an elevator 2 for a stack of sheets (not shown), and an air supply system 2 configured to supply and direct one of more air streams towards an upper region 4 of the sheet feeding device 1 for floating a plurality of upper sheets of the stack of sheets, wherein the elevator 2 comprises a vertically movable support 5 for supporting the stack of sheets from below. The sheet feeding device 1 also comprises a first side support member 6 and a second side support member 7 configured to sideways support respective opposite sides of the stack of sheets. Also, the sheet feeding device 1 comprises a vacuum belt feeder 8 provided above the elevator 2 and configured to grab and feed away an uppermost sheet of the floated sheets.

Figure 2:
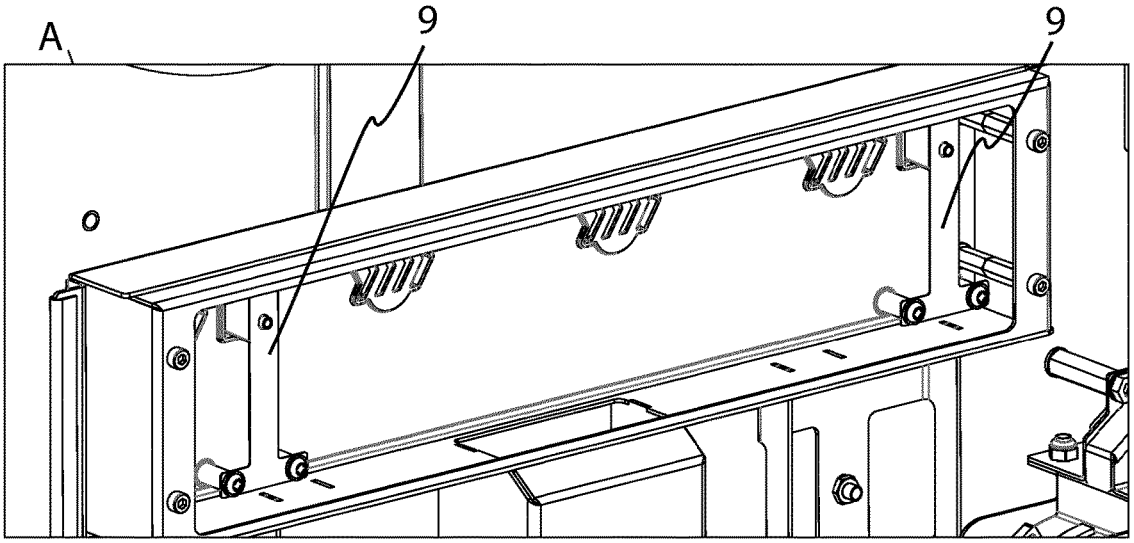
FIG. 2 shows detail view A in which the two right hand cams are visible.

Further, an upper portion of each side support member is provided with two respective cams 9 extending obliquely upwards-inwards D1, D2 from the respective side support member 6, 7. This means that the guiding surface of the cams extend upwards-inwards D1, D2 from the respective side support member 6, 7. As shown in FIGS. 1 and 2, each side support member 6, 7 comprises two spaced apart cams 9, one in the front and one in the back of the side support member 6, 7. The front of each side support member 6, 7 is closest to the vacuum belt feeder.

It should be understood that the cover plates, for illustrative purposes, are not shown in FIGS. 1 and 2. One cover plates is usually mounted over the opening of the space of each side support member, in which space the cams are mounted. The plate ensures that an over pressure can be achieved inside each space such that air can be forced out of the four arrow shaped air outlets of each side support member 6, 7. The lower central portion if FIG. 1 shows one fan for increasing air pressure in the space of the second side support member 7.

Figure 3:
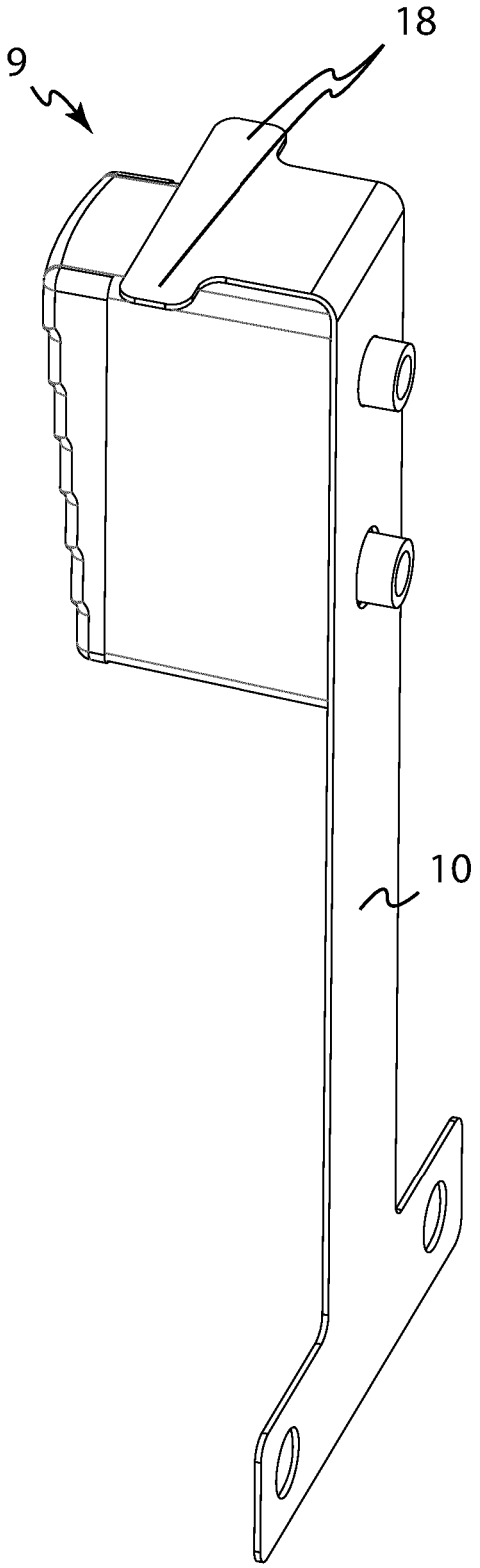
FIG. 3-4 show the design of an embodiment of the cams used in the sheet feeding device.
Figure 4:
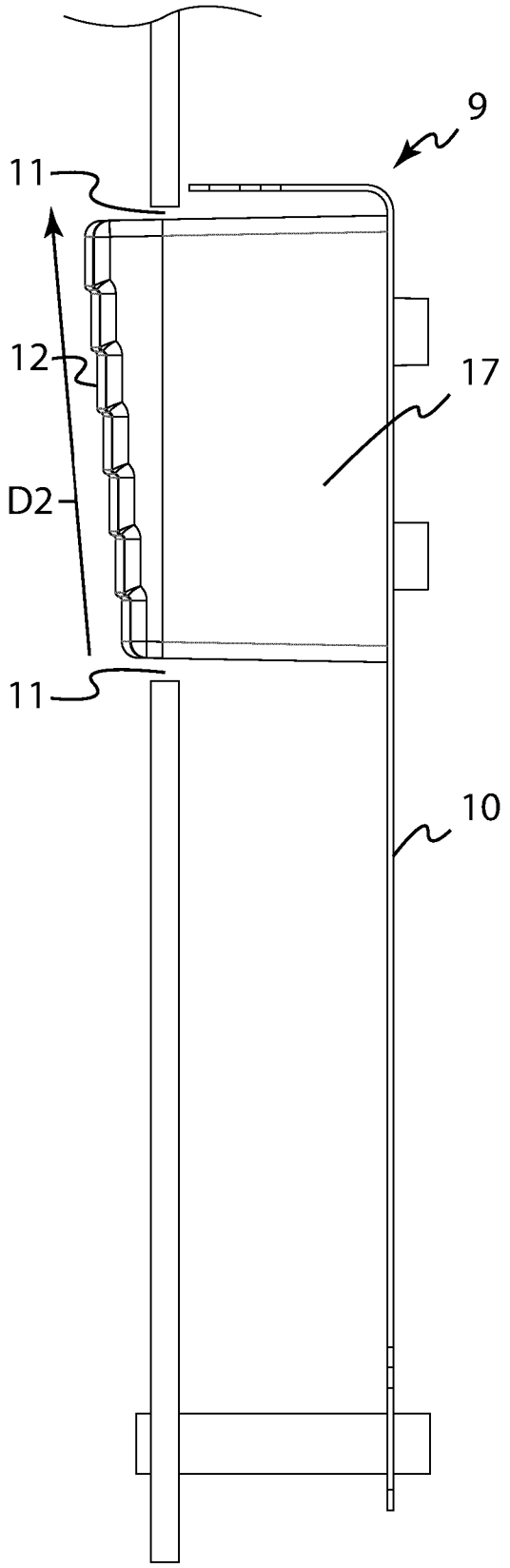

In the present embodiment, all cams 9 are identical and FIGS. 3 and 4 show the design of such a cam 9. Each cam 9 is resilient and can thus be pressed outwards by pressure from the sheet. The resiliency can be achieved in many ways; In this embodiment, each cam 9 comprises an elongate resilient stem 10 by which the cam 9 is attached to the respective side support member 6, 7. The stem 10 is made of spring steel and extends vertically below a head 17 of the cam 9, which head 17 provides the guiding surface 12 for the sheet to move along. The cam head 17 is made of injection molded plastic but could in other embodiments be made of any other material and produced using any other suitable method. The head 17 is attached to the stem 10 by means of screws but any other suitable means could alternatively be used, such as riveting or press fit. Each cam 9 is positioned such that its head 17 extends through a respective opening or recess 11 in the upper portion of the side support member 6, 7. The hole or recess 11 is formed in a wall plate of the side support member, which wall plate provides a support surface for the stack of sheets. The cam 9 is attached on the 'outside' of the respective side support member 6, 7, said outside facing away from the stack of sheets, wherein a lower portion of the stem 10 is attached to the side support member 6, 7. In this embodiment, the guiding surface 12 of the cam 9 is stepped, as shown in FIG. 4. The steps extend substantially horizontally and thus provide a 'vertically stepped' guiding surface 12. The provision of steps provides a plurality of cam portions with increased resistance for the sheets to slide along at floating and thereby promotes controlled separation of floated sheets. In other embodiments, the guiding surface 12 of the cam could alternatively be straight/planar or arcuate. Further, instead of geometrical steps, the steps could in other embodiments alternatively be provided in the form of portions of the guiding surface provided with means for providing locally increased friction at said portions, such as a TPU or rubber layer, a patterned surface structure or similar.

The vertical positioning and extension of the cams 9 are such that cams 9 guide the sheet all the way up to the position in which the vacuum belt feeder 8 is able to grab the sheet. Thus, the cams 9 ensure that the uppermost sheet is bent when the vacuum belt feeder 8 grabs it. Bent sheets are stiffer than planar sheets and thus easier to handle since they are more stable.

In this embodiment, each cam 9 is provided with a respective stop means 18 in the form of protrusions provided on the stem 10. The stop means 18 is configured to limit movement of the cam 9 by engaging the side support member 5, 6 thereby preventing unwanted movement of the cam by 9 restricting its movement to a predetermined range of movement. In the present embodiment, the protrusions of the stop means 18 are provided on the outside of the side support member 6, 7 and extends wider than the opening or recess 11 of the side support member 6, 7 such that the stop means 18 cannot move through the opening or recess 11, thereby defining an innermost position of the cam 9. The innermost position is thus the position in which the distance between opposite cams 9 is smallest. From the inner position, the sheet(s) press the cam 9 outwards to increase the distance between opposite cams 9. The outwards movement of each cam 9 is made against the reactive force of elastic deformation of the respective stem 10.

Generally, the cams 9 could in other embodiments alternatively be replaced with cams 9 having other designs, such as having the head 17 integrated as a part of the stem 10 deformed to provide the guiding surface 12 for the sheet to slide along. Further, the number of cams 9 provided on each side support member 6, 7 could be greater or lower than two as long as at least one cam 9 is provided on each side support member 6, 7.

The first 6 and second 7 side support members are movably attached to the sheet feeding device 1 such that their mutual intermediate distance is adjustable for supporting stacks of different width. The first 6 and second 7 side support members may be biased inwards by to thereby press on the stack of sheets, for example by means of elastic deformation of the stem 10.

As shown in FIGS. 1 and 6, the vertically movable support 5 comprises a raised central portion 13 extending along the length of the sheet feeding device 1 in the feeding direction 14 of the uppermost sheet. The raised central portion 13 is defined by two ribs/beams and respective left and right support plates which are slightly tilted to raise inner portions of the respective plates as shown. In other embodiments, the raised central portion 13 of the vertically movable support 5 could be achieved in any suitable way, such as by provision of one or more central elongate protrusions extending above the height of the rest of the vertically movable support 5.

Figure 5:
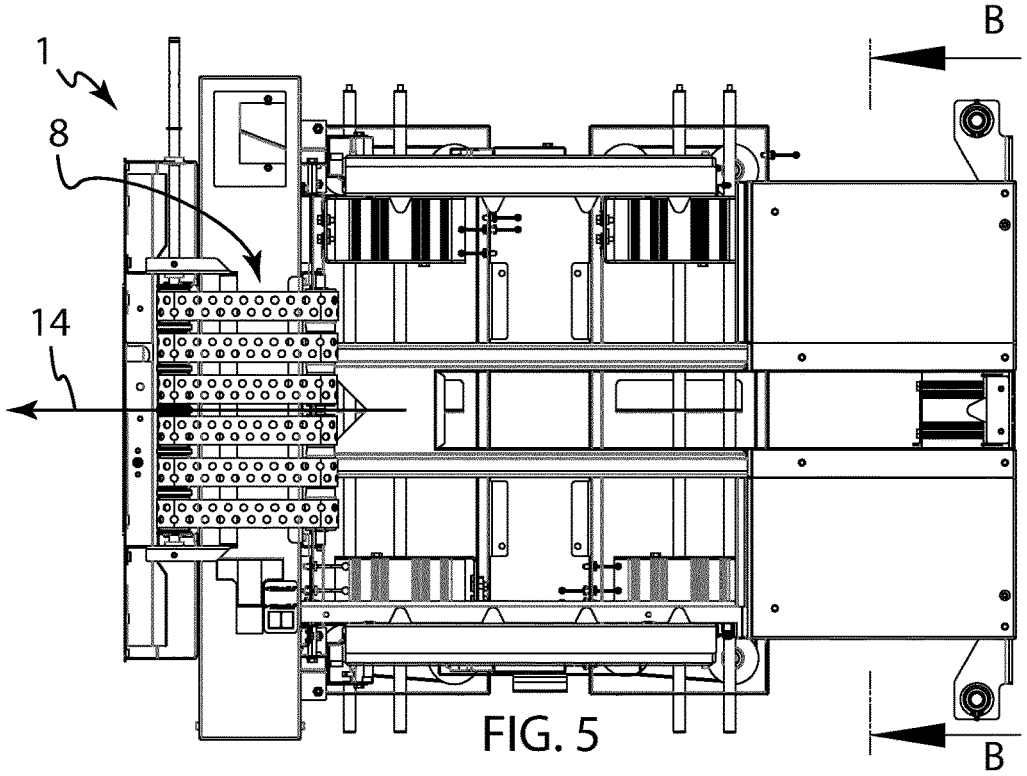
FIG. 5 shows a top view of the sheet feeding device of FIGS. 1-2.

As shown in FIG. 5, the vacuum belt feeder 8 comprises opposite outer lower belt portions 15 separated by intermediate lower belt portions 16 provided higher than the outer portions. In this particular embodiment, there are six belts three to the left and three to the right. The two innermost belts are positioned with the lower belt portions 1 mm above the lower belt portions of the outer belts. The other two intermediate belts are positioned with their lower belt portions 0.5 mm higher than the lower belt portions of the outer belts. From one side to the other the vertical offsets of the lower portions of the respective six belts as measured from lowest one are thus: [0 mm, 0.5 mm, 1 mm, 1 mm, 0.5 mm, 0 mm]. Upper portions of the respective belts may run at any height as defined by roller arrangements around which the belts are mounted. Together, the outer 15 and intermediate 16 lower belt portions provide an arcuate belt assembly, in other words a belt assembly providing an arcuate feeding surface. Instead of six belts any number of belts could be used as long as they together are configured to provide an arcuate feeding surface.

In this embodiment, the three inventive concepts of 1. cams for bending the sheets, 2. arcuate vertically movable support and 3. arcuate vacuum belt feeder are used together to mitigate prior art short comings and promote trouble-free operation of the feeding device. However, in other embodiment, the cams 9 could be used without the need of the arcuate vertically movable support 5, such as with a planar support surface of the vertically movable support 5. Also, the cams 9 could be used without the arcuate vacuum belt feeder 8, such as with a planar vacuum belt feeder. However, the positive effects on trouble-free operation increase when the three concepts are used together.

The sheet feeding device 1 is typically also provided with a controller (not illustrated) configured to control the vertical position of the vertically movable support 5, to control the air supply system 3 and to control the vacuum belt feeder 8. The controller operates the vertically movable support 5 as needed to account for sheets fed out of the sheet feeding device 1. Further, the controller operates the air supply system 3 to provide proper floating with good separation of sheets floated. Also the controller operates the vacuum belt feeder 8 to grab the uppermost sheet floated and move it away to be fed out of the sheet feeding device 1. The specifics regarding the control logic of the air supply system 3, the vacuum belt feeder 8 and the operation of the vertically movable support 5 of the elevator 2 goes beyond the scope of the present invention and will therefore be omitted from the present disclosure.

The invention claimed is:

1. A sheet feeding device comprising an elevator for a stack of sheets, and an air supply system configured to supply and direct one of more air streams towards an upper region of the sheet feeding device for floating a plurality of upper sheets of the stack of sheets, wherein the elevator comprises a vertically movable support for supporting the stack of sheets from below, wherein the sheet feeding device comprises a first side support member and a second side support member configured to sideways support respective opposite sides of the stack of sheets, wherein the sheet feeding device further comprises a vacuum belt feeder provided above the elevator and configured to grab and feed away an uppermost sheet of the floated sheets, and wherein an upper portion of each side support member is provided with at least one respective cam comprising a respective stepped guiding surface extending obliquely upwards-inwards from the respective side support member, and wherein steps of the stepped guiding surface extend substantially horizontally, such that a vertically stepped guiding surface is provided.

2. The sheet feeding device according to claim 1, wherein each cam is resilient.

3. The sheet feeding device according to claim 1, wherein each cam comprises an elongate resilient stem by which the cam is attached to the respective side support member.

4. The sheet feeding device according to claim 3, wherein the elongate resilient stem of each cam extends vertically below the cam on an outside of the respective side support member facing away from the stack of sheets, wherein a lower portion of the elongate resilient stem is attached to the respective side support member.

5. The sheet feeding device according to claim 3, wherein the side support members are provided with an opening or recesses, and wherein the cam extends through the opening or recess from an outside of the respective side support member to its inside.

6. The sheet feeding device according to claim 1, wherein the first and second side support members are movably attached to the sheet feeding device such that their mutual intermediate distance is adjustable for supporting sheets of different width.

7. The sheet feeding device according to claim 1, wherein the vertically movable support comprises a raised central portion extending along a length of the sheet feeding device in the feeding direction of the sheet feeding device.

8. The sheet feeding device according to claim 1, wherein the vacuum belt feeder comprises opposite outer lower belt portions separated by an intermediate lower belt portion provided higher than the outer lower belt portions.

* * * * *